United States Patent [19]

Poggiolini

[11] Patent Number: 5,052,136

[45] Date of Patent: Oct. 1, 1991

[54] ARTWORK ASSEMBLY

[76] Inventor: Marcello Poggiolini, 107 Wildevy Avenue, Lynwood Manor, Pretoria, Transvaal Province, South Africa

[21] Appl. No.: 429,325

[22] Filed: Oct. 31, 1989

[30] Foreign Application Priority Data

Nov. 2, 1988 [ZA] South Africa ..... 88/8207

[51] Int. Cl.[5] ..... G09F 1/12

[52] U.S. Cl. ..... 40/156; 40/152

[58] Field of Search ..... 40/152, 154, 603, 604, 40/156, 152.1, 159.1; 248/488, 490

[56] References Cited

U.S. PATENT DOCUMENTS

| | | | |
|---|---|---|---|
| 445,305 | 1/1891 | Tidball | 40/152.1 X |
| 2,632,971 | 3/1953 | Manczek et al. | 40/152.1 X |
| 3,310,901 | 3/1967 | Sarkisian | 40/156 |
| 4,373,279 | 2/1983 | Abel et al. | 40/152.1 X |
| 4,906,503 | 3/1990 | De La Cruz et al. | 40/604 X |

FOREIGN PATENT DOCUMENTS

| | | | |
|---|---|---|---|
| 2057870 | 4/1981 | United Kingdom | 40/156 |

*Primary Examiner*—Peter R. Brown
*Assistant Examiner*—J. Bonifanti
*Attorney, Agent, or Firm*—Hayes, Soloway, Hennessey & Hage

[57] ABSTRACT

An artwork assembly 30 comprises a frame 35 defining an opening; an artwork 42 located within the frame and spaced from at least one side of the frame so that there is a gap between the artwork and that side of the frame, and mounting devices 10 extending from the frame to the artwork so as to span the gap between the artwork and the frame, thereby to mount the artwork within the frame.

6 Claims, 4 Drawing Sheets

ARTWORK ASSEMBLY

This invention relates to an artwork assembly. It relates also to a mounting device for use in such an assembly, and to a method of mounting an artwork within a frame, to form such an artwork assembly.

The Applicant is aware of an artwork assembly which comprises a frame and an artwork, e.g. a painting or other artwork representation, located within the frame and spaced therefrom, with the artwork being mounted to a backing or facing sheet also forming a surround between the artwork and the frame. However, such an assembly has the drawback that it can be expensive and heavy, especially when the artwork is of substantial size, i.e. when the backing or facing sheet has to be of substantial thickness, and hence mass, to support the artwork.

It is hence an object of this invention to provide an artwork assembly whereby this drawback is at least reduced.

According to a first aspect of the invention there is provided a mounting device for mounting an artwork within a frame, the device comprising an elongate member; first mounting means in proximity to one end of the member and adapted for mounting to a frame such that the elongate member protrudes inwardly from the frame; and second mounting means in proximity to the other end of the elongate member and adapted for mounting to an artwork.

The elongate member may be non-linear so that the first and second mounting members are staggered with respect to each other when the device is seen from the side.

In one embodiment of the invention, the elongate member may be of rigid and non-extensible form. However, in another embodiment of the invention, it may be extensible to cater for different sized artworks and frames. It may then comprise two elongate components slidable axially with respect to each other and securing means securing them together releasably. Hence, the one component can be of tubular form, with the other being of rod-like form and located slidably spigot-socket or telescopic fashion within the tubular component, and the connecting means comprising a grub screw or the like for connecting the components together.

The elongate member may be of any desired cross-section, e.g. rounded, square, or the like. It may further be provided with a finish to render it aesthetically attractive, e.g. a coat of paint, polished, epoxy-coated, chrome-plated, or the like.

Each mounting means may comprise a bracket extending transversely to the elongate member, and being provided with least one aperture through which a fastening element can pass to attach the bracket to the artwork or frame.

According to a second aspect of the invention there is provided a method of mounting an artwork within a frame, which comprises securing the artwork to an inner end of at least one elongate mounting member extending inwardly from the frame into an opening defined by the frame, so that the artwork is spaced from the frame.

The frame may be square or rectangular, with the securing of the artwork being affected by means of a plurality of the mounting members protruding inwardly from the corners of the frame.

According to a third aspect of the invention, there is provided an artwork assembly which includes a frame defining an opening; an artwork located within the frame and spaced from at least one side of the frame so that there is a gap between the artwork and that side of the frame; and at least one mounting device extending from the frame to the artwork so as to span the gap between the artwork and the frame, thereby to mount the artwork within the frame.

The artwork may be located such that the gap extends around the artwork, with a plurality of the mounting devices, spaced apart around the artwork being provided. The artwork may be located out of the plane of the framework, and may be located either centrally within the opening, or off-centre.

The mounting devices may each comprise an elongate member with first mounting means at one end of the elongate member and mounted to the frame, and second mounting means at the other end of the elongate member and mounted to the artwork. Hence, the mounting devices may be those according to the first aspect of the invention.

The invention will now be described by way of example, with reference to the accompanying diagrammatic drawings.

In the drawings.

Figure 2:
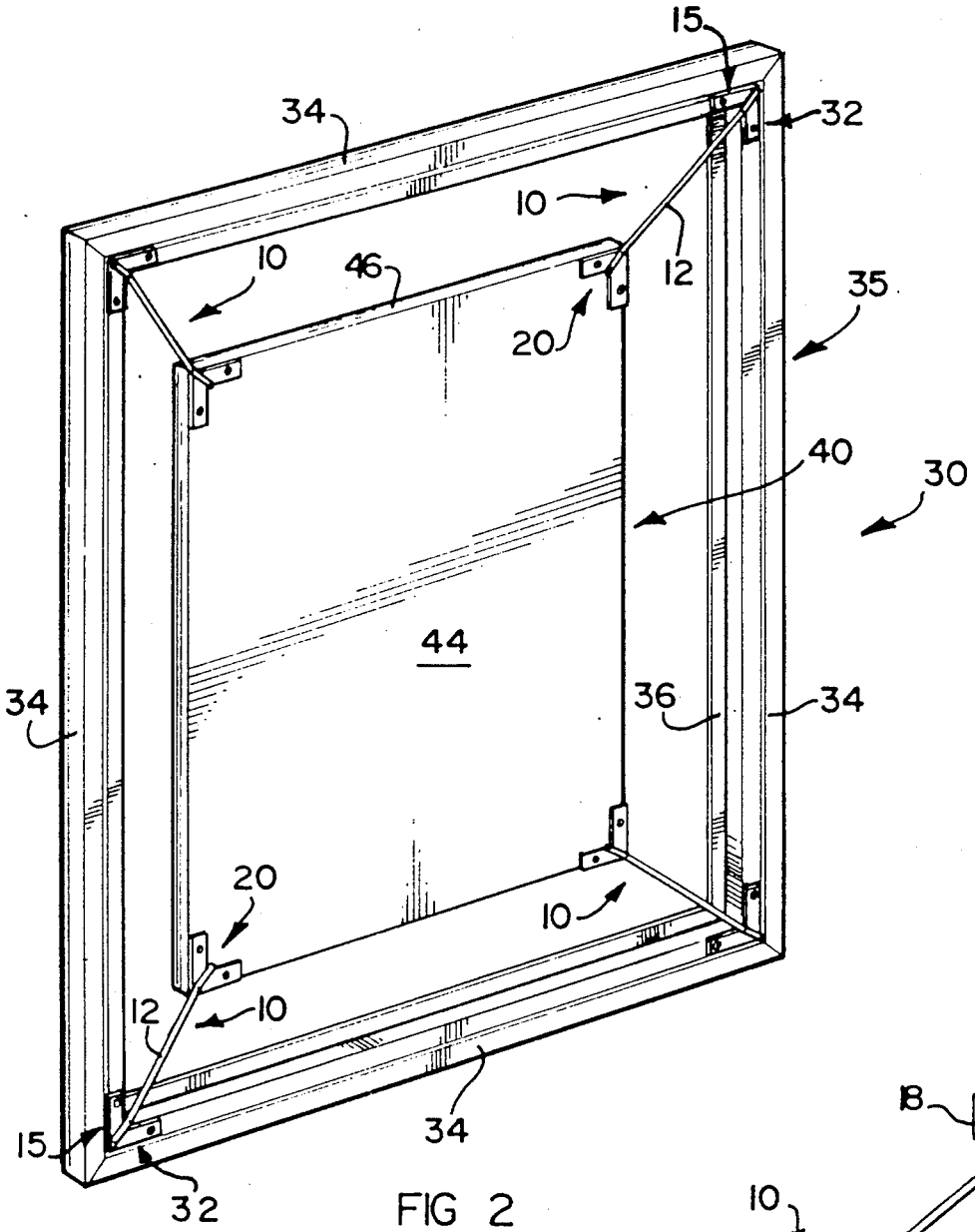
FIG. 2 shows a three-dimensional view from the rear of an artwork assembly according to the third aspect of the invention, incorporating mounting devices according to FIG. 1.
Figure 1:
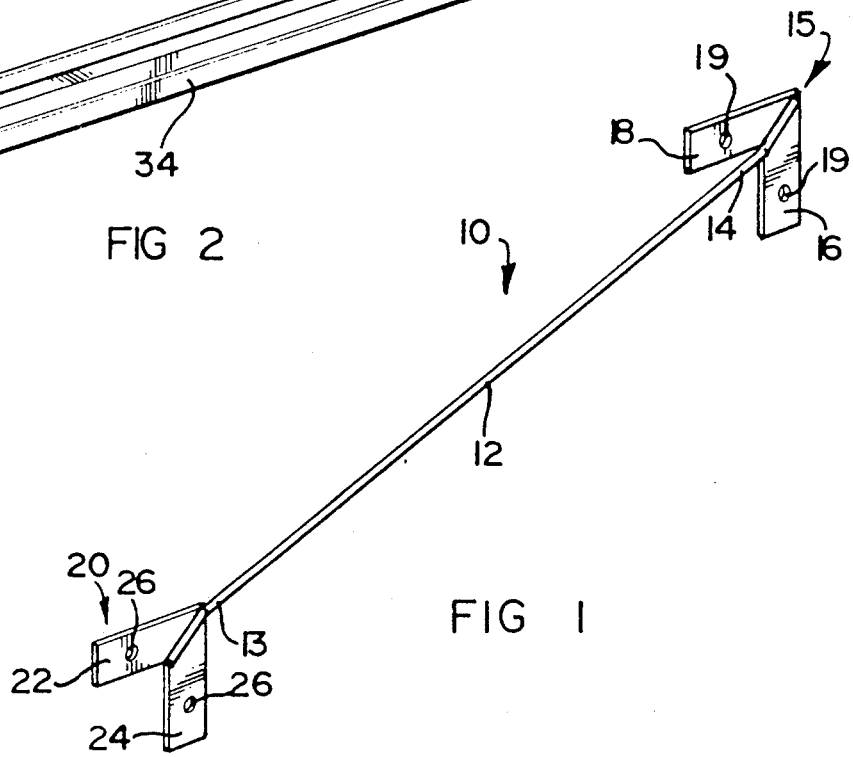
FIG. 1 shows a three-dimensional view of a mounting device to the first aspect of the invention.
Figure 3:
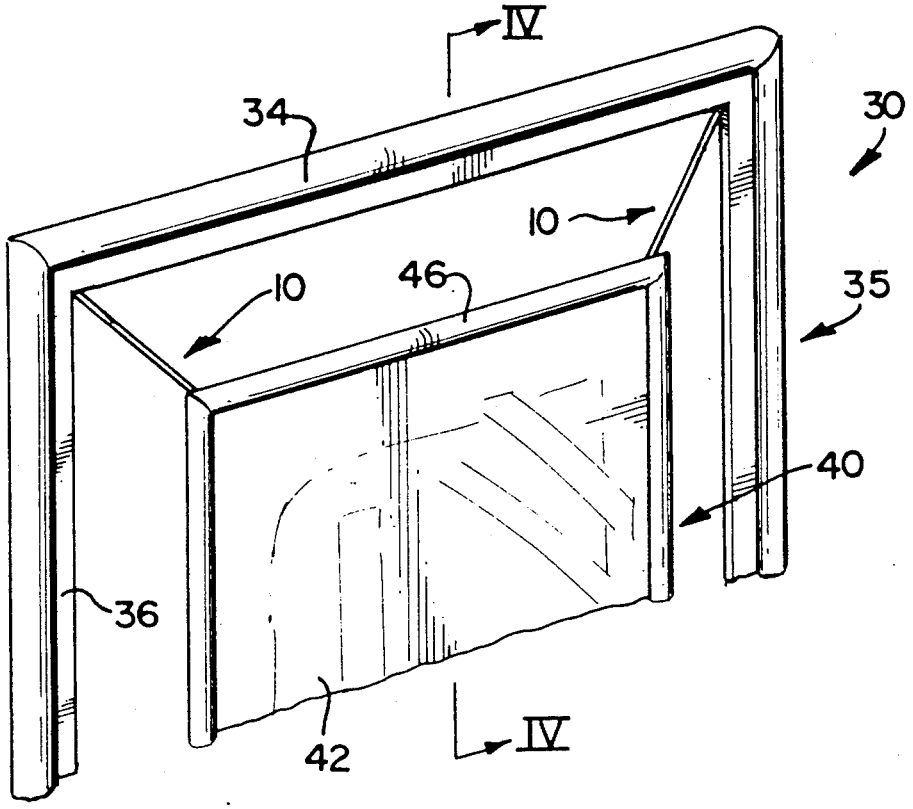
FIG. 3 shows, in part, a three-dimensional view from the front of the artwork, assembly of FIG. 2.
Figure 4:
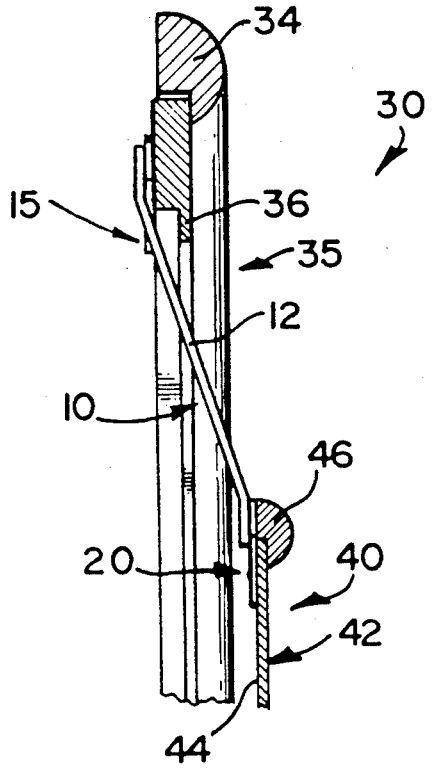
FIG. 4 shows a sectional view through IV—IV in FIG. 3.
Figure 5:
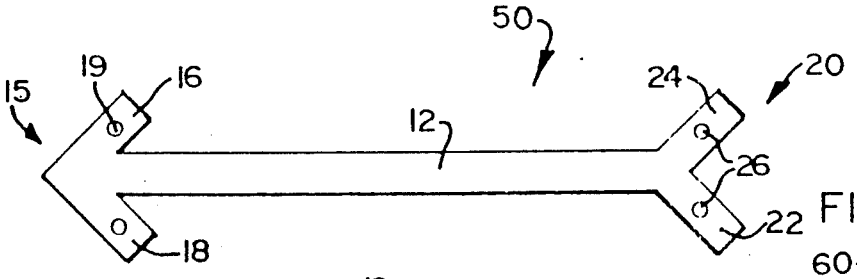
FIGS. 5 to 11 show plan views of a number of alternative versions of a mounting device according to the first aspect of the invention.
Figure 6:
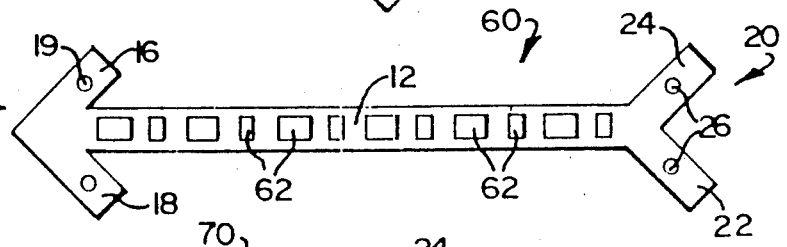
Figure 7:
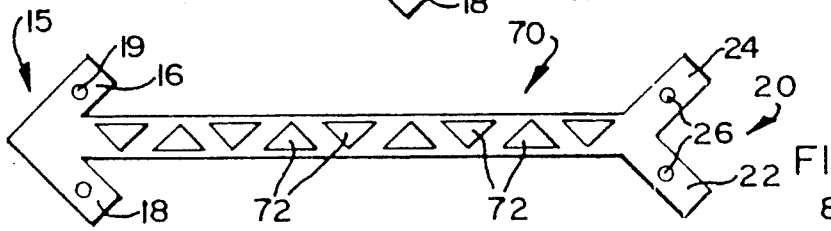
Figure 8:
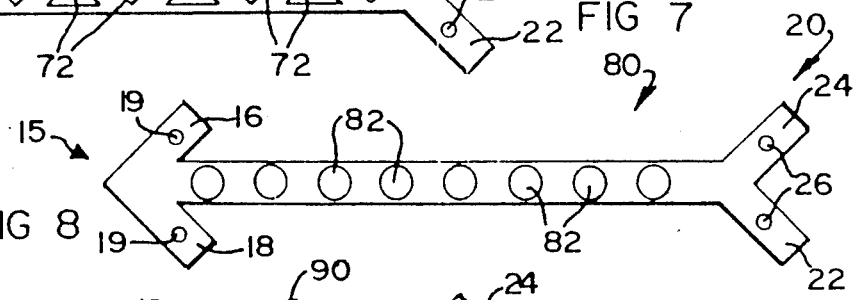
Figure 9:
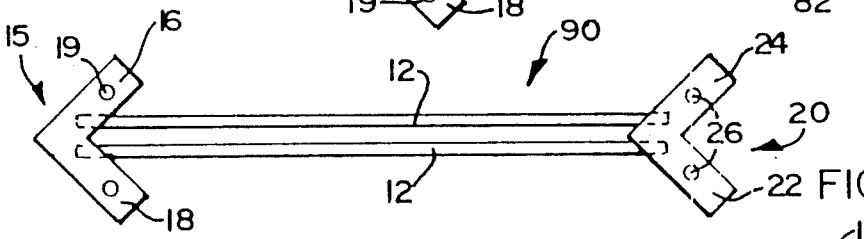
Figure 10:
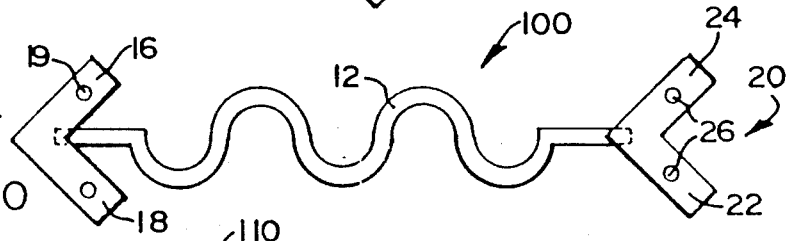
Figure 11:
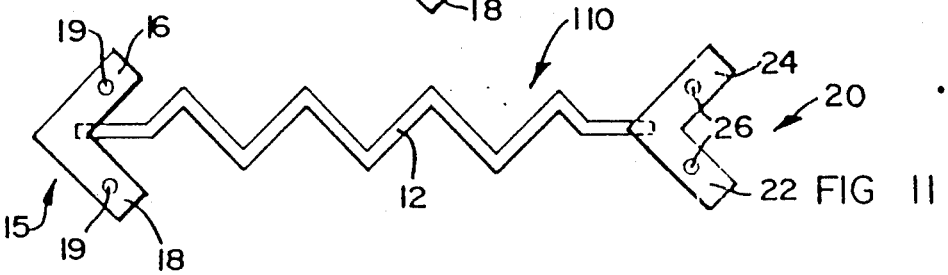

Referring to FIGS. 1 to 4, reference numeral 10 generally indicates a mounting device according to the first aspect of the invention.

The mounting device 10 includes an elongate member 12. The elongate member 12 is of rigid material, such as steel, plastics material, polycarbonate, or the like. It can have a suitable finish to render it aesthetically pleasing, e.g. painted a desired colour, epoxy-coated, polished, chrome-plated, or the like. When it is of plastics material, the plastics material can be any desired colour or be transparent. It can be of any desired cross-section, e.g. round, square, triangular, or the like.

To a first end 14 of the member 12 there is attached a bracket, generally indicted by reference numeral 15. The bracket 15 comprises planar portions 16, 18 extending orthogonally to each other. The planar portions 16, 18 are arranged such that included angles of about 45° are formed with the member 12. In each of the planar portions 16, 18 is provided an aperture 19.

To the other end 13 of the member 12 is attached a bracket, generally indicted by reference numeral 20. The bracket 20 is of planar form, and has portions 22, 24 which extend generally in the same directions as the portions 18, 16 respectively of the bracket 15. In each of the bracket portions 22, 24 there is also provided an aperture 26.

The brackets 15, 20 can be of any suitable material. For example, they may be of the same material as the member 12 and may be integral with the member 22 or attached thereto by means of adhesive, welding, or the like. The brackets 15, 20 can, however, be of a different material to the member 22, if desired.

To form an artwork assembly or presentation 30, the brackets 15 of four devices 10 are located respectively in the corners 32 defined by sides 34 of a square or rectangular frame 35. Each of the sides 34 of the frame 35 is provided with a flange-like portion 36 which serves to conceal the bracket 15 when the assembly 30 is viewed from the front (see FIG. 3). The elongate members 12 hence protrude inwardly from the corners 32 of the frame 35, with the brackets 15 being secured to the frame by means of screws which pass through the apertures 19 into the frame.

An artwork sub-assembly 40 is located within the frame 35. The artwork sub-assembly 40 comprises an artwork 42, e.g. a painting or representation, on a backing sheet 44 which is mounted to a sub-frame 46. The brackets 20 at the inner ends of the members 12 are secured to the corners of the artwork sub-assembly 40 by means of screws which pass through the apertures 26 in the bracket portions 22, 24. In this fashion, the artwork sub-assembly 40 is mounted within the frame.

The brackets 15, 20 and members 12 are arranged such that the artwork sub-assembly 40 lies out of the plane of the frame 35, rendering the presentation assembly 30 aesthetically striking, since the artwork 42 is then spaced from a wall from which the frame 35 hangs.

In yet further embodiments of the invention, the brackets 15, 20 can be of any other suitable shape. For example, some of the devices 10 may be provided with brackets 15, 20 which are of elongate planar form so that they can be mounted to the framework members 34 at their midpoints, rather than at the corners. The brackets 15 can also be of planar form, similar to the brackets 20, if desired, depending upon the configuration and shape of the framework 35.

Referring to FIGS. 5 to 11, reference numerals 50, 60, 70, 80, 90, 100 and 110 respectively generally indicate other versions of mounting devices according to the first aspect of the invention.

Part of the devices 50–110 which are the same or similar to those of the device 10, are indicated with the same reference numerals.

The devices 50–110 are generally similar to the device 10, save that their members 12 differ. For example, the members 12 of the devices 50, 60, 70 and 80 are somewhat broader, for greater rigidity. Furthermore, the member 12 of the devices 60, 70 and 80 are provided with apertures 62, 72 and 82 respectively, to give them a different appearance. The device 90 has a pair of parallel elongate members 12, while the elongate members 12 of the devices 100, 110 are of convoluted form, to render them visually distinctive.

Figure 12:
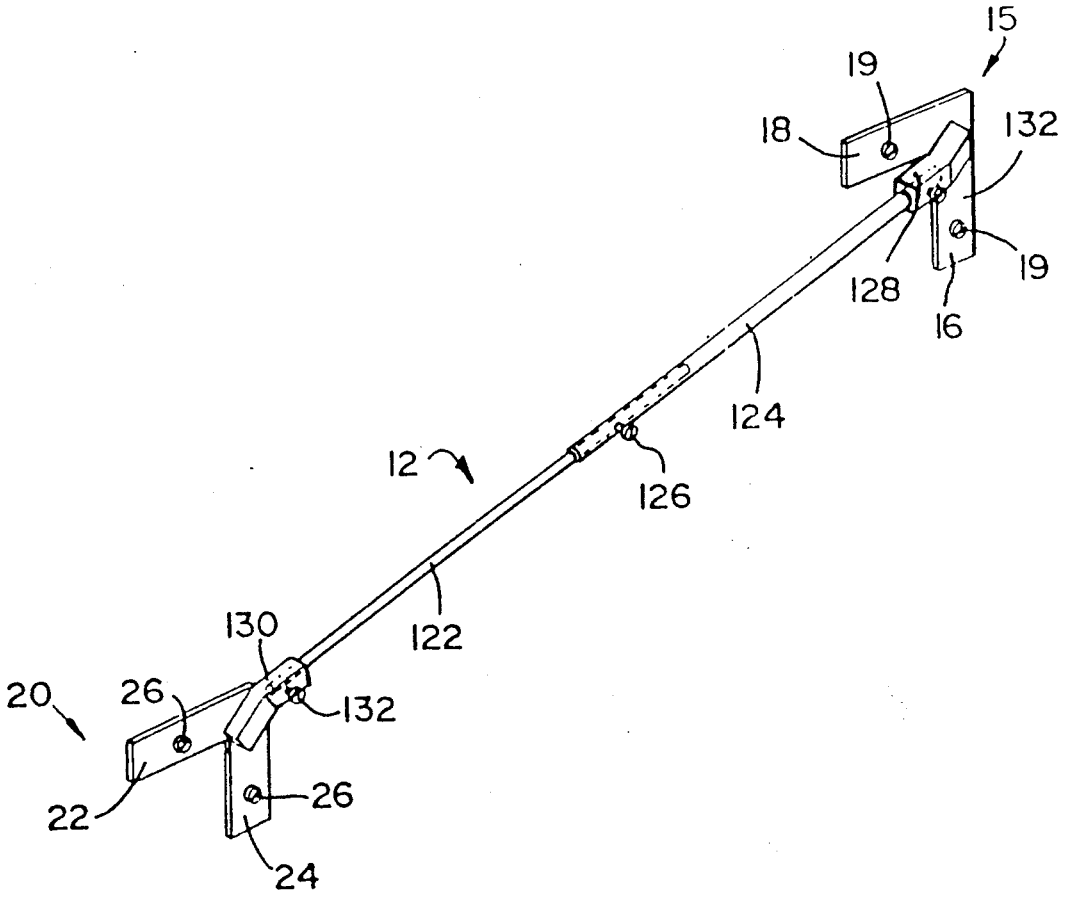
FIG. 12 shows an exploded three-dimensional view of yet another version of a mounting device according to the first aspect of the invention.

Referring to FIG. 12, reference numeral 120 generally indicates yet another version of a mounting device according to the first aspect of the invention.

Parts of the device 120 which are the same or similar to those of the device 10, are indicated with the same reference numerals.

The device 120 also comprises an elongate member 12, and brackets 15, 20. However, its elongate member 12 comprises two elongate components 122, 124 slidable telescopically or spigot-socket fashion with respect to each other, such that the member 12 of the device 120 is extensible. It also includes a grub screw 126 for securing the components 122, 124 together in a desired position.

The device 120 also includes mounting boxes or members 128, 130 on the brackets 15, 20 respectively, for securing the respective ends of the member 12. The ends of the member 12 are insertable into the mounting boxes 128, 138 and securable thereto by means of grub screws 132.

Hence, the device 120 is provided in knock-down form.

The Applicant believes that with the mounting devices according to the invention, an aesthetically striking artwork assembly can be formed. For example, when such an artwork assembly or presentation is mounted to a wall, the wall colour and finish will effectively form the surround between the artwork and the frame. Still further, the frame and sub-frame can be selected to complement each other, e.g. be of the same cross-sectional shape, be of contrasting colours, etc.

I claim:

1. A mounting device for mounting an artwork within a frame, the device comprising a rigid, non-extensible elongate member; first mounting means is proximity to one end of the member and adapted for mounting to a frame such that the elongate member protrudes inwardly from the frame; and second mounting means in proximity to the other end of the elongate member and adapted for mounting to an artwork, the elongate member being non-linear and each mounting means comprising a planar bracket extending transversely to the elongate member and having at least one aperture through which a fastening element can pass to attach the bracket to the artwork or frame with the first and second brackets thus being staggered with respect to each other when the device is seen from the side, and lying in spaced parallel planes.

2. An artwork assembly which comprises a frame defining an opening; an artwork located within the frame and spaced from at least one side of the frame so that there is a gap between the artwork and that side of the frame; and at least one mounting device extending from the frame to the art work so as to span the gap between the artwork and the frame, thereby to mount the artwork within the frame, the mounting device comprising a rigid elongate member, first mounting means at one end of the elongate member and mounted to the frame, and second mounting means at the other end of the elongate member and mounted to the artwork, with the first and second mounting means being located such that they are not visible from the front of the assembly, each of the mounting means comprising a planar bracket extending transversely to the elongate member and having at least one aperture through which a fastening element passes to attach the bracket to the artwork or frame, with the planes in which the brackets lie being spaced apart and extending parallel to each other so that the artwork is located out of the plane of the frame.

3. An artwork assembly according to claim 2, wherein the brackets are mounted to the rear sides of the frame and artwork respectively.

4. An artwork assembly according to claim 2, wherein a plurality of the mounting devices spaced apart about the frame-work are provided, with at least one of the mounting devices comprising a tubular component to the one end of which is mounted the one bracket and a rod-like component to the one end of which is mounted the other bracket and its other end being located slidably telescopic fashion in the tubular component; and securing means for securing the components together.

5. A mounting device for mounting an artwork within a frame, the device comprising a rigid, non-extensible elongate member; first mounting means in proximity to one end of the member and adapted for mounting to a rear surface of a frame such that the elongate member protrudes inwardly rom the frame; and second mounting means in proximity to the other end of the elongate member and adapted for mounting to a rear surface of an artwork, the elongate member being non-linear and each mounting means comprising a planar bracket extending transversely to the elongate member and having at least one aperture through which a fastening element can pass to attach the bracket to the artwork or framed with the first and second brackets thus being staggered with respect to each other when the device is seen from the side.

6. An artwork assembly which comprises a frame defining an opening; an artwork located within the frame and spaced from at least one side of the frame so that there is a gap between the artwork and that side of the frame; and at least one mounting device extending from the frame to the artwork so as to span the gap between the artwork and the frame, thereby to mount the artwork within the frame, the mounting device comprising a rigid elongate member, first mounting means at one end of the elongate member and mounted to a rear surface of the frame, and second mounting means at the other end of the elongate member and mounted to a rear surface of the artwork, with the first and second mounting means being located such that they are not visible from the front of the assembly, each of the mounting means comprising a planar bracket extending transversely to the elongate member and having at least one aperture through which a fastening element passes to attach the bracket to the rear surface of the artwork or frame, with the planes in which the brackets lie being spaced apart so that the artwork is located out of the plane of the frame.

* * * * *

UNITED STATES PATENT AND TRADEMARK OFFICE

CERTIFICATE OF CORRECTION

PATENT NO. : 5,052,136

DATED : October 1, 1991

INVENTOR(S) : Poggiolini, Marcello

It is certified that error appears in the above-identified patent and that said Letters Patent is hereby corrected as shown below:

Claim 5, Col. 5, line 11 "rom" should be "from"; and
Claim 5, Col. 5, line 19 "framed" should be "frame".

Signed and Sealed this

Eighth Day of June, 1993

*Attest:*

Michael K. Kirk

MICHAEL K. KIRK

*Attesting Officer*

*Acting Commissioner of Patents and Trademarks*